US007318444B2

(12) United States Patent
Clarke

(10) Patent No.: US 7,318,444 B2
(45) Date of Patent: Jan. 15, 2008

(54) HUB ASSEMBLY FOR AN UMBRELLA FRAME

(75) Inventor: Dougan H. Clarke, Miami Beach, FL (US)

(73) Assignee: TUUCI Engineering & Design, Inc., Miami, FL (US)

( * ) Notice: Subject to any disclaimer, the term of this patent is extended or adjusted under 35 U.S.C. 154(b) by 282 days.

(21) Appl. No.: 10/748,755

(22) Filed: Dec. 30, 2003

(65) Prior Publication Data

US 2004/0206382 A1 Oct. 21, 2004

Related U.S. Application Data

(60) Provisional application No. 60/437,103, filed on Dec. 30, 2002.

(51) Int. Cl.
*A45B 25/06* (2006.01)

(52) U.S. Cl. ..... 135/29; 135/28; 403/172; 403/217

(58) Field of Classification Search ..... 135/28–30, 135/90, 98, 135, 147, 159, 38; 211/197; 403/170, 174, 176, 217; 52/646, 656.9
See application file for complete search history.

(56) References Cited

U.S. PATENT DOCUMENTS 2,745,421 A 5/1956 Russell
4,368,749 A 1/1983 Lindler et al.
4,832,304 A 5/1989 Morgulis
4,834,126 A * 5/1989 Sweet, Jr. ..... 135/15.1
4,993,445 A 2/1991 Dubinsky
5,020,557 A 6/1991 Apple
5,031,371 A * 7/1991 Davister ..... 52/236.1
5,069,410 A * 12/1991 McKee ..... 248/475.1
5,193,566 A 3/1993 Chen
5,355,903 A 10/1994 Haddad et al.
5,444,946 A * 8/1995 Zeigler ..... 52/86
5,615,697 A * 4/1997 Lin et al. ..... 135/20.1

(Continued)

FOREIGN PATENT DOCUMENTS

EP 897678 A1 * 2/1999

(Continued)

*Primary Examiner*—Winnie Yip
(74) *Attorney, Agent, or Firm*—Malloy & Malloy, P.A.

(57) ABSTRACT

An umbrella frame provides a stable and enduring support for an umbrella canopy while also allowing canopies of varying shapes and sizes to be mounted thereto. The umbrella frame includes a hub assembly, namely, a main hub member mounted about a central pole member of the umbrella frame which offers improved means for attaching brackets thereto which are structured to pivotally receive a plurality of strut members therein, which strut members are, in turn, pivotally secured to a plurality of rib members interconnected with an upper, secondary hub. The main hub member of the present invention preferably includes an upper portion, a lower portion, and a channel having at least one ledge formed therebetween, with a band formed from a flattened strip of metal secured within the channel about the hub member. The channel is formed to have the same general height dimension as the brackets, which are secured to the band and the hub member and are confined within the space defined by the channel so as to prevent rotation or twisting thereof. As such, the present invention provides for an umbrella frame which is more sturdy and durable and yet, which allows the size and shape of the attached canopy to be readily varied.

20 Claims, 6 Drawing Sheets

U.S. PATENT DOCUMENTS 5,640,984 A 6/1997 Dubunsky
5,836,328 A 11/1998 Lee
5,911,493 A * 6/1999 Walker et al. ..... 362/102
6,314,976 B1 * 11/2001 Clarke ..... 135/28
6,325,084 B1 * 12/2001 Cohen ..... 135/16
6,729,076 B1 * 5/2004 Gale ..... 52/74

FOREIGN PATENT DOCUMENTS

JP 2002142824 A * 5/2002

* cited by examiner

HUB ASSEMBLY FOR AN UMBRELLA FRAME

CLAIM OF PRIORITY

The present application is based on and a claim to priority is made under 35 U.S.C. Section 119(e) to a provisional patent application currently pending in the U.S. Patent and Trademark Office having Ser. No. 60/437,103 and a filing date of Dec. 30, 2002.

BACKGROUND OF THE INVENTION

1. Field of the Invention

This invention relates to umbrellas, and more particularly, to a hub assembly for an umbrella frame. The hub assembly of the present invention offers improvements primarily, but not exclusively, in durability and the withstanding of abusive weather conditions.

2. Description of the Related Art

Large, standing outdoor umbrellas are commonly utilized at restaurants, bars, hotels, and other places that offer outdoor seating so as to shield people from the sun, as well as from other elements of nature, such as wind, light rain, etc. As such, these types of outdoor umbrellas typically have been designed to endure some of these elements. Nevertheless, damage to the framework of an umbrella can and does occur for many reasons. For example, umbrellas can be damaged by severe and unexpected weather and strong winds can cause a standing outdoor umbrella to fall over, which can cause component parts of the umbrella frame to become cracked or bent. Others suffer damage as a result of improper handling, such as when a worker moves them from one location to another quickly or recklessly and/or as a result of improper installation. Many of the umbrellas known in the art suffer the disadvantages of not being able to withstand strong winds or other harsh weather, as well as not being capable of simple repair when damage does occur.

For example, many standing outdoor umbrellas utilize a wood material, which quite often is highly polished, for the hub assembly, ribs, struts, and other frame components due to the pleasing esthetic effect which it offers. However, these assemblies often require that screws or other connectors be driven into the wood material, which compromises the material's strength and integrity. In particular, when these types of umbrellas fall over, a common result is that the wood splits at the site or sites where a screw has been screwed into the wood. Unfortunately, once an umbrella is damaged in this way, it is often more expensive and difficult to repair the frame component(s) of the umbrella than it is to replace them or in some cases, the umbrella itself. This is especially true when the wood hub assembly of the umbrella frame has been split or otherwise damaged.

SUMMARY OF THE INVENTION

The present invention is intended to present a solution to some of the problems in this field of art, and as such, relates to a hub assembly for an outdoor umbrella which is better able to withstand the forces to which they are commonly subjected. The hub assembly of the present invention is also better suited towards being repaired in a relatively simple manner in the event it were to become damaged.

The hub assembly of the present invention comprises a hub member having a central aperture sized to receive a pole member of the umbrella frame and capable of sliding up and down the pole member. The hub member includes an upper portion and a lower portion, and in a first embodiment, further includes a band secured about a periphery thereof between the upper and lower portions, with a plurality of brackets secured to at least the band, but ideally also to the hub member. The brackets are structured to pivotally receive an end of a strut member of the umbrella frame, as further described in greater detail herein. In another embodiment, the hub member further includes a channel formed generally in the upper portion thereof, which is defined by at least a lower ledge, but ideally an upper ledge as well, extending entirely or substantially about a periphery of the hub member. The channel has a height dimension that is sized to correspond generally with the height dimension of said brackets. Preferably, a band is also secured to the hub member in this embodiment, but secured within the channel and about the hub member. However, the present invention also contemplates an embodiment of the hub member which includes the channel but not the band secured thereto, i.e., wherein the brackets are received within and secured directly within the channel to the hub member.

In another embodiment, the inventive hub member has upper and lower portions which are separate and distinct from one another, and which collectively form a channel between them in an assembled orientation. Here as well, the channel formed between the upper and lower portions is preferably defined by at least one ledge, such as a bottom ledge, but preferably also a top ledge as well, with the height of the channel sized to correspond to the height of a plurality of brackets to be secured within the channel and to the hub member.

In yet another embodiment, the hub member additionally comprises a ring, and most preferably, a ring having a solid, one piece construction. In the illustrated embodiment, the ring includes a first exposed, horizontally oriented surface and a second exposed, horizontally oriented surface, and further, the upper portion of the hub-member is disposed adjacent to the first exposed ring surface and the lower portion of the hub member is disposed adjacent to the second exposed ring surface in an assembled orientation. The ring preferably also includes a plurality of pre-formed brackets structured to pivotally receive an end of a strut member of the umbrella frame, and further, is free to rotate about the pole member, at least, if not within or between the hub member's upper and lower portions.

A primary object of the present invention is to provide a hub assembly for an umbrella frame which is less likely to crack, split, explode or suffer other damage as a result of the umbrella's falling over or undergoing windy conditions or other stress and forces.

Another object of the present invention is to provide a hub assembly for an umbrella frame which is capable of withstanding fluctuations between hot and cold temperatures, as well as withstanding extreme temperatures, and also, wind and other weather conditions.

It is a further object of the present invention to provide a hub assembly for an umbrella frame which provides better stability for brackets and/or other components used in attaching the rib and/or strut members to the umbrella frame.

It is another object of the present invention to provide an umbrella frame having easily replaceable and interchangeable parts.

Still another object of the present invention is to provide an improved hub assembly which in at least one embodiment is capable of rotating about the pole member of the umbrella frame, at a minimum.

BRIEF DESCRIPTION OF THE DRAWINGS

FIG. 3-B is an isolated view of a hub assembly similar to that of FIG. 3-A but wherein the hub assembly is a split hub assembly.

FIG. 5-B is a partial perspective view of the bottom side of the ring illustrated in FIG. 5-A.

DETAILED DESCRIPTION OF THE PREFERRED EMBODIMENT(S)

Figure 1:
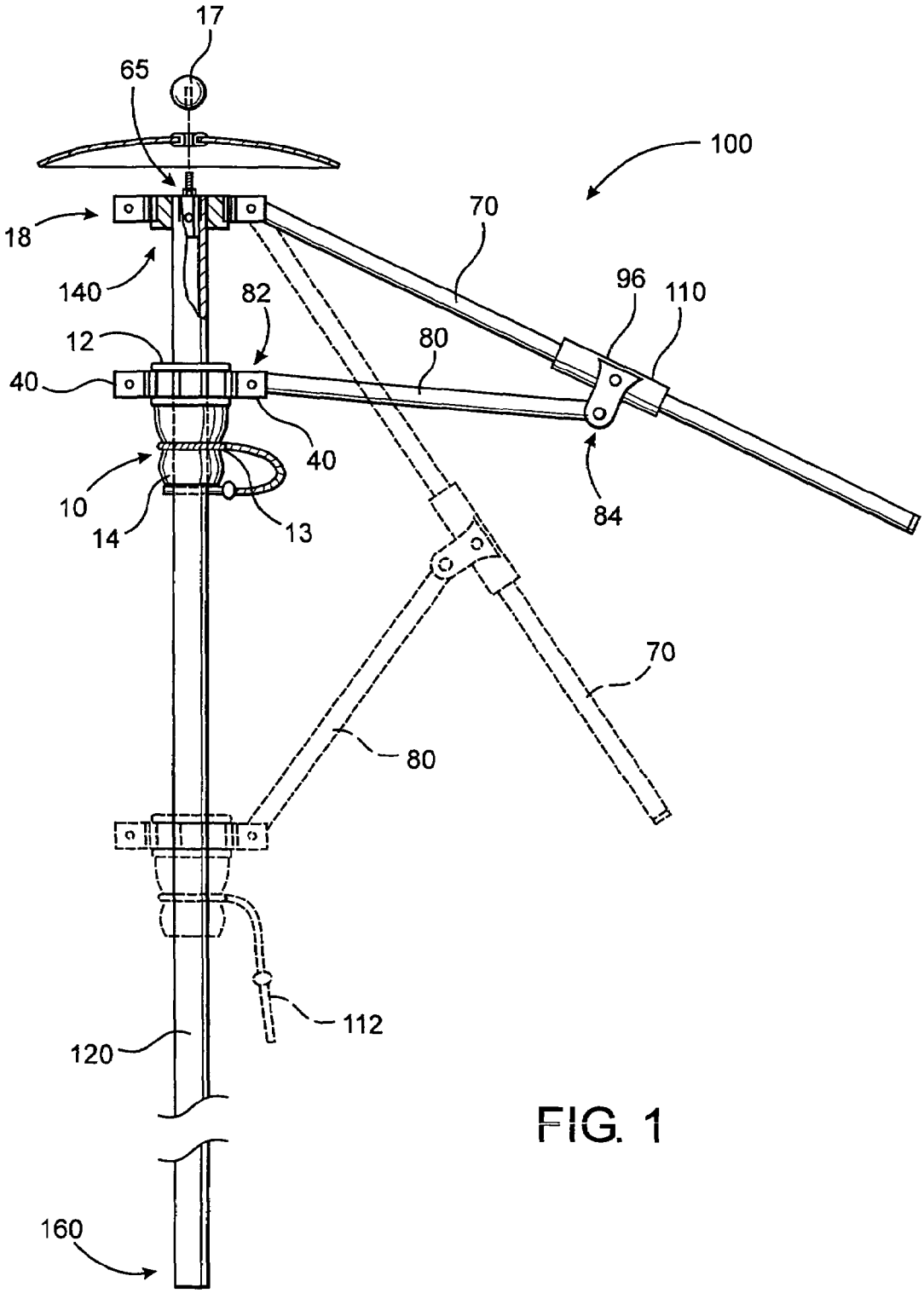
FIG. 1 is a is a partial, exploded, front elevational view showing an umbrella frame—with which the present invention may be used—in an open position, and further, a partially closed position as indicated by the phantom and dashed lines.

The present invention is directed to a hub assembly 10 for an umbrella, and preferably, but not necessarily, a large, upright, outdoor umbrella of the type used at restaurants, bars, and on patios, decks, etc. While this invention is susceptible of embodiment in many different forms, there is shown in the drawings and will herein be described in detail at least one specific embodiment, with the understanding that the present disclosure is to be considered as an exemplification of the principles of the invention and is not intended to limit the invention to the embodiment or embodiments illustrated.

By way of background, and with reference to FIG. 1, the umbrella with which the invention is utilized will typically include a frame 100 having a longitudinally extending, central pole member 120, which can be made of wood, aluminum or another material, and which has a top end 140 and a bottom end 160. The bottom end 160 may be easily secured to the ground or any means of vertical affixment, although in the preferred embodiments the bottom end 160 may be secured within a base, not shown, which will ideally have wheels to facilitate movement of the umbrella from one place to another. The hub assembly comprises a main hub member 10, which is designed and configured to be interconnected with other components of the umbrella frame 100, has a central aperture 15, best shown in FIG. 2, extending axially therethrough for placement about the central pole member 120 and is slidable between the top 140 and bottom 160 ends of the pole member so as to permit the opening of the umbrella, as well as the closing of the umbrella, as indicated by the phantom lines shown in FIG. 1. In at least one embodiment, the hub member 10 is also capable of rotating about the axis of the pole member 100.

Figure 2:
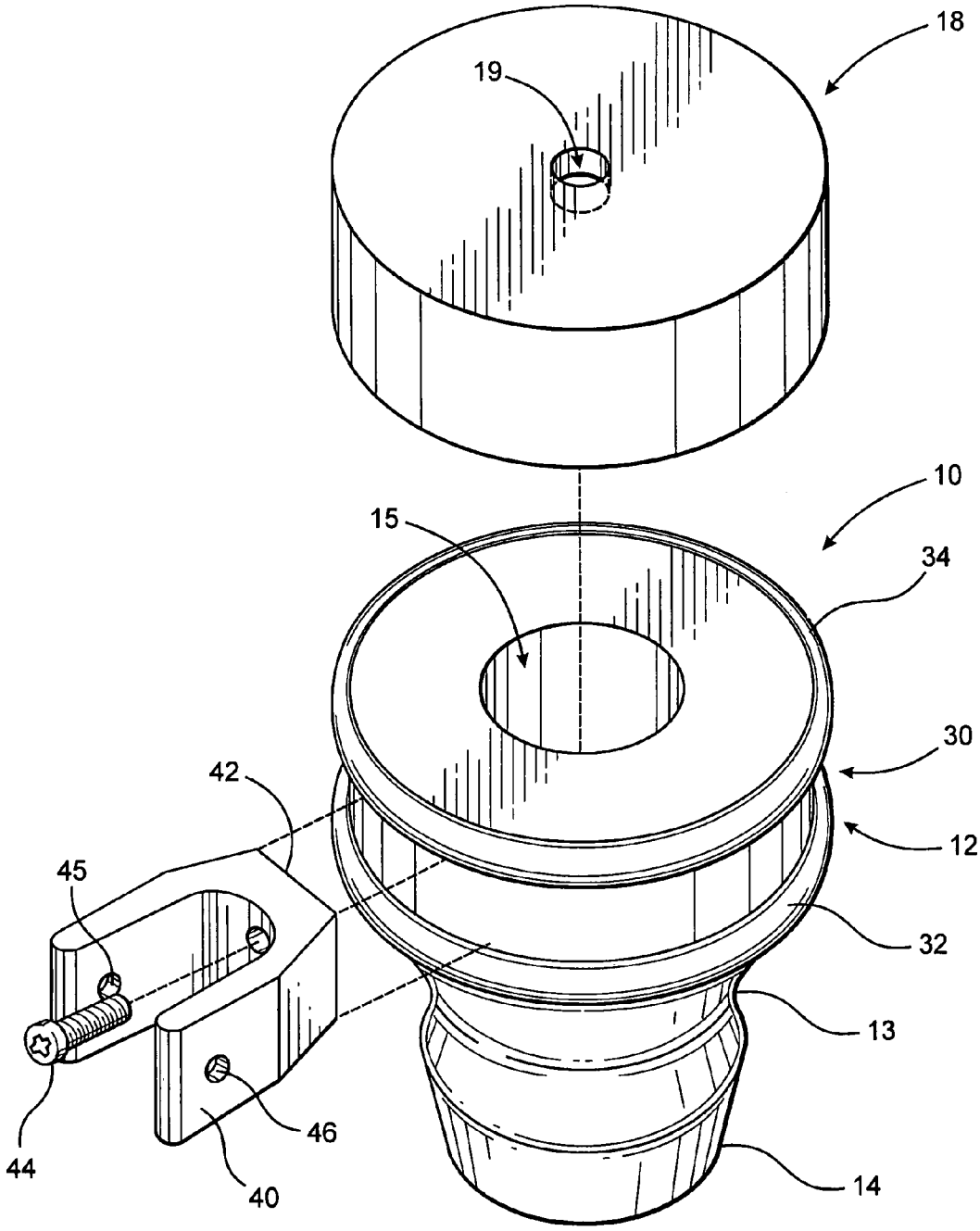
FIG. 2 is an exploded perspective view of a hub assembly for an umbrella frame according to one embodiment of the present invention.

As also shown in FIG. 1, the umbrella frame 100 also includes an upper or secondary hub member 18 near the top end 140 of the pole 120. In the more preferred embodiments, this secondary hub member 18 is provided with a central cavity 19 extending axially therethrough for receiving the top end 140 of the pole 120, as shown in FIG. 2, and ideally, is structured and configured to securely depend from the top, end 140 of the pole, an inventive feature described in a previously filed U.S. patent application of the inventor herein, namely, Ser. No. 10/008,536 filed on Nov. 13, 2001, incorporated herein by reference. For example, and as shown in FIG. 1, the central pole member 120 can include a threaded bolt 65 (whether secured to an exterior surface thereof or formed to extend from an interior thereof). This threaded bolt 65 is of a length sufficient to extend through a narrow upper portion of the central cavity 19 of the secondary hub member 18 such that a nut tightened about the bolt 65 will be capable of maintaining the secondary hub member 18 in substantially rigid position about the pole 120. When desired, however, the nut may be loosened somewhat so as to allow the secondary hub member 18 to rotate about the pole's axis, a feature which is helpful during windy or other adverse weather conditions. A finial or end cap 17 can also be secured to the bolt 65 for aesthetic purposes once a canopy has been positioned atop the umbrella frame 100. The end cap 17 also maintains the fabric canopy in a secured central position.

Still referring to FIG. 1, the umbrella frame 100 includes a plurality of rib members 70 which form the outer framework of the umbrella and also a plurality of strut members 80. The rib and strut members may similarly be made of wood, plastic, or aluminum, another metal or other material, and the umbrella frame 100 can utilize any desired number and size of rib and strut members, depending on the particular size and shape of the umbrella canopy to be attached. Each of the rib members 70 are preferably secured pivotally at a top end thereof to the upper or secondary hub member 18. Each of the strut members 80 are preferably secured pivotally at a first end 82 to the hub assembly 10 and are also preferably secured pivotally at a second end 84 to the rib members 70 at a point near the approximate midpoint of the rib members. The strut members 80 provide support for the rib members when the umbrella frame is in the extended or open position. The preferred pivotal attachment of the rib members 70 to the upper or secondary hub 18 and of the strut members 80 to the main hub member 10 will be discussed in greater detail subsequently herein. As also shown in FIG. 1, a retaining pin 112 can be attached to the hub member 10 and can be placed within a retaining pin slot formed within the pole 120 in order to maintain the vertical position of the hub member 10 along the pole 120. In addition, the pin 112 can be secured to the hub member 10 via a cord having a noose loosely secured about the waist 13 of the hub member 10 SO as to allow for the free rotation of the hub member 10 about the pole 120, even when the pin 112 is in place within the pin retaining slot. Other structures can be utilized to maintain the vertical position of the hub member 10 along the pole 120, although ideally an inventive feature described as a "cam cleat member" in a previously filed U.S. patent application of the inventor herein will be used, with said feature being shown and described fully in U.S. Pat. No. 6,386,214 issued on May 14, 2002, and also in Ser. No. 10/008,536 filed on Nov. 13, 2001, both of which are incorporated herein by reference.

Referring more in particular now to the main hub member 10, it is pointed out that in many embodiments it will be formed out of wood, preferably polished to offer a refined appearance, but that it could also be made from a number of other materials. In addition, the hub member 10 can have many different shapes, but preferably, includes both an upper portion 12 and a lower portion 14. As is perhaps best shown in FIG. 2, the hub member 10 ideally includes a waist 13 so as to result in a generally hour-glass shape which provides comfort and which ergonomically fits better into one's hand for maneuverability of the hub member 10 up and down along the umbrella frame's central pole member 120.

Figure 4:
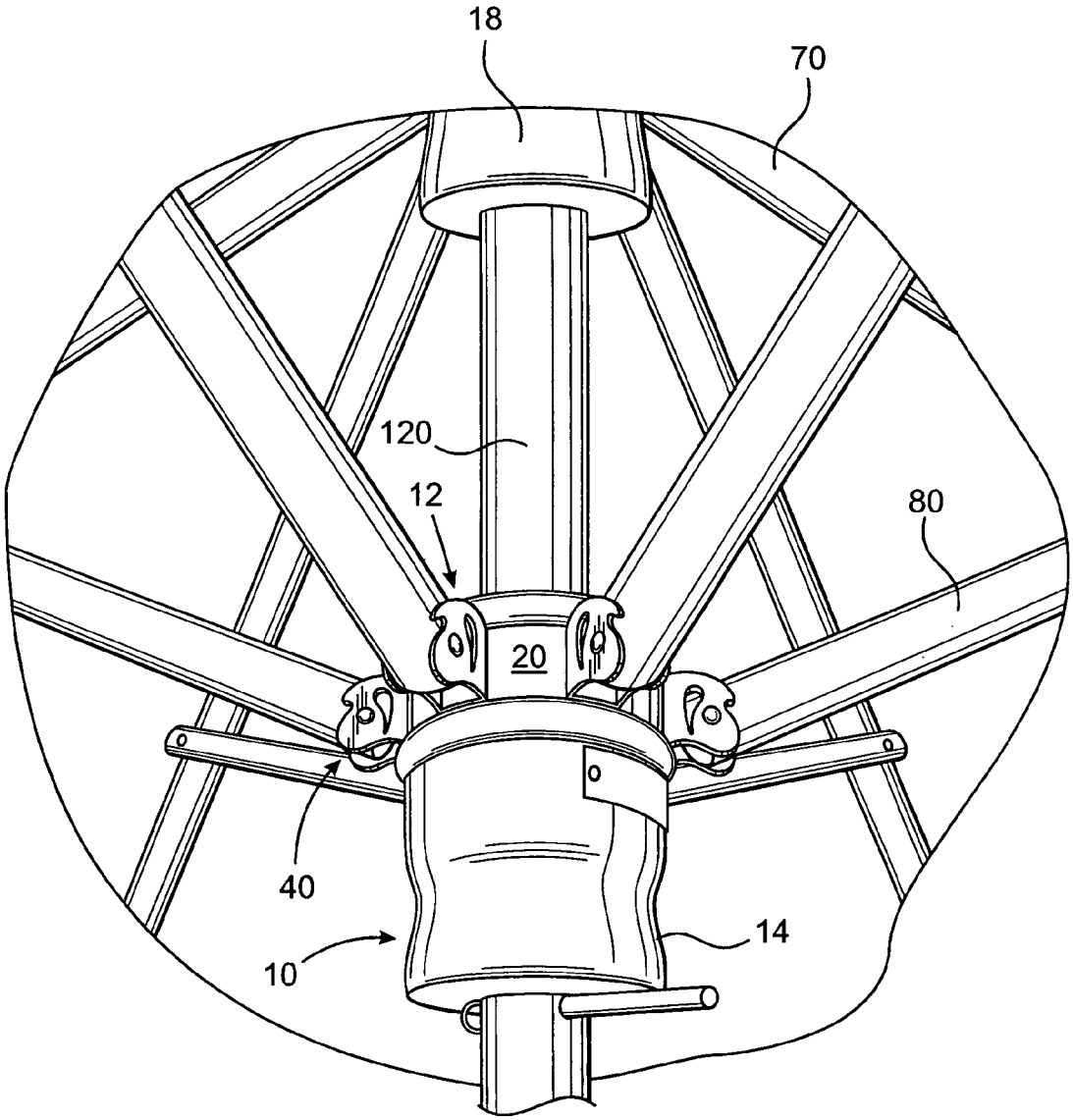
FIG. 4 is an isolated view of a hub assembly according to yet another embodiment of the invention, shown assembled and in place on an umbrella frame in an open orientation.

In at least one embodiment, and as illustrated in FIG. 4, the hub assembly 10 of the present invention also includes a band 20. In particular, the band 20, which can be made from a thin, flat strip of steel or other metallic material is preferably wrapped around the girth or external peripheral surface of the hub member 10, ideally at or near the upper portion 12 thereof and is fixed in this location. For example, the band 20 may be secured to the hub member 10 by a set of screws driven into the wood of the hub assembly 10 so as to anchor the opposite free ends of the band 20. For the purpose of pivotally attaching the first ends 82 of the strut members 80 to the hub member 10, a plurality of bracket members 40 are affixed to the periphery of the band 20, for example, by way of one or more screws 44 being driven through each bracket member 40, through the underlying band 20 and into the wood or other material of the hub member 10. It is contemplated that the band 20 may be formed from other materials, including but not limited to other metals, composites, plastic, etc. In addition, the brackets may be made of a metal material, probably a stamped metal, but could also be made of other materials, including plastic.

Figure 3A:
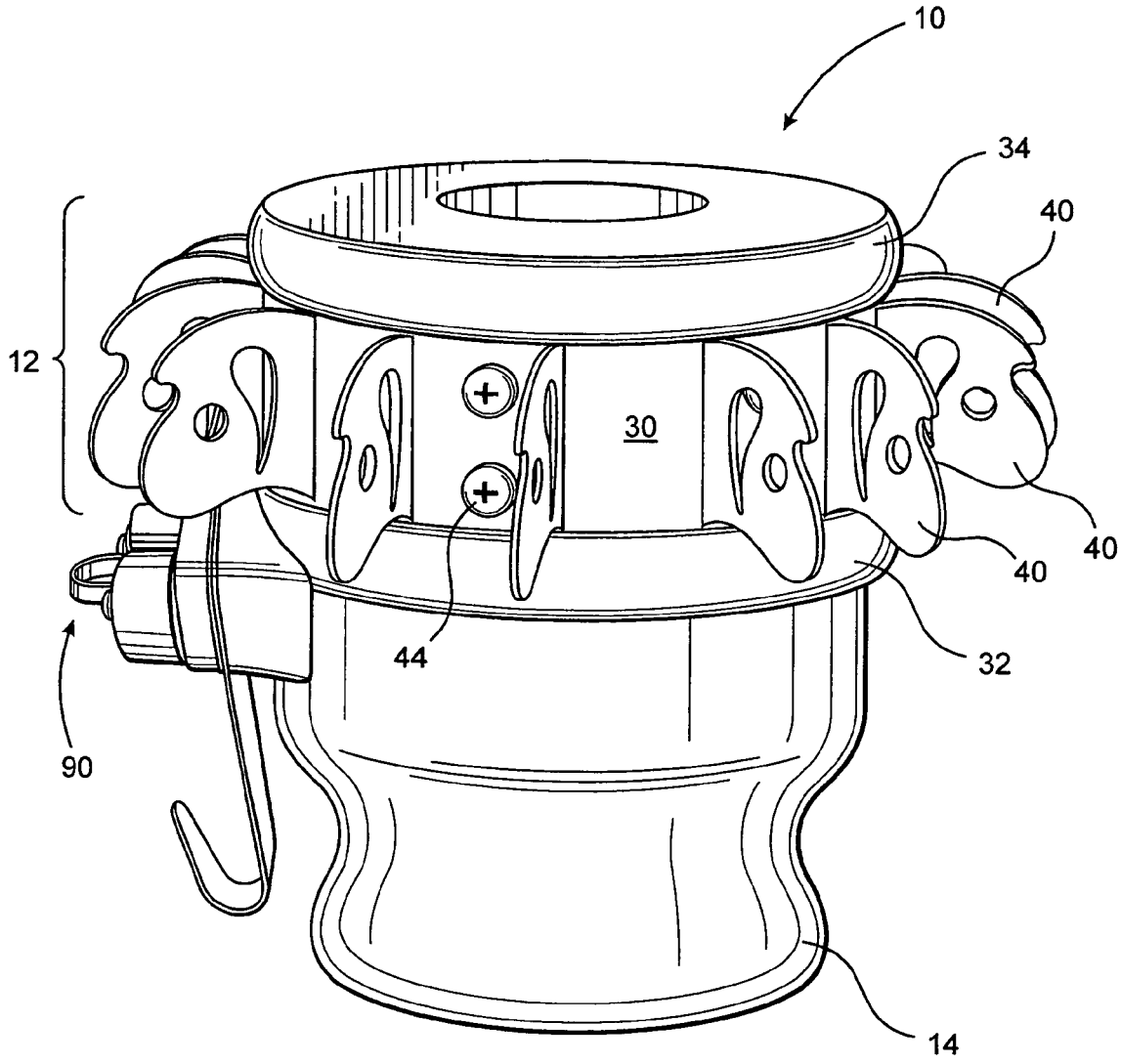
FIG. 3-A is an isolated view of a hub assembly according to another embodiment of the invention.
Figure 3B:
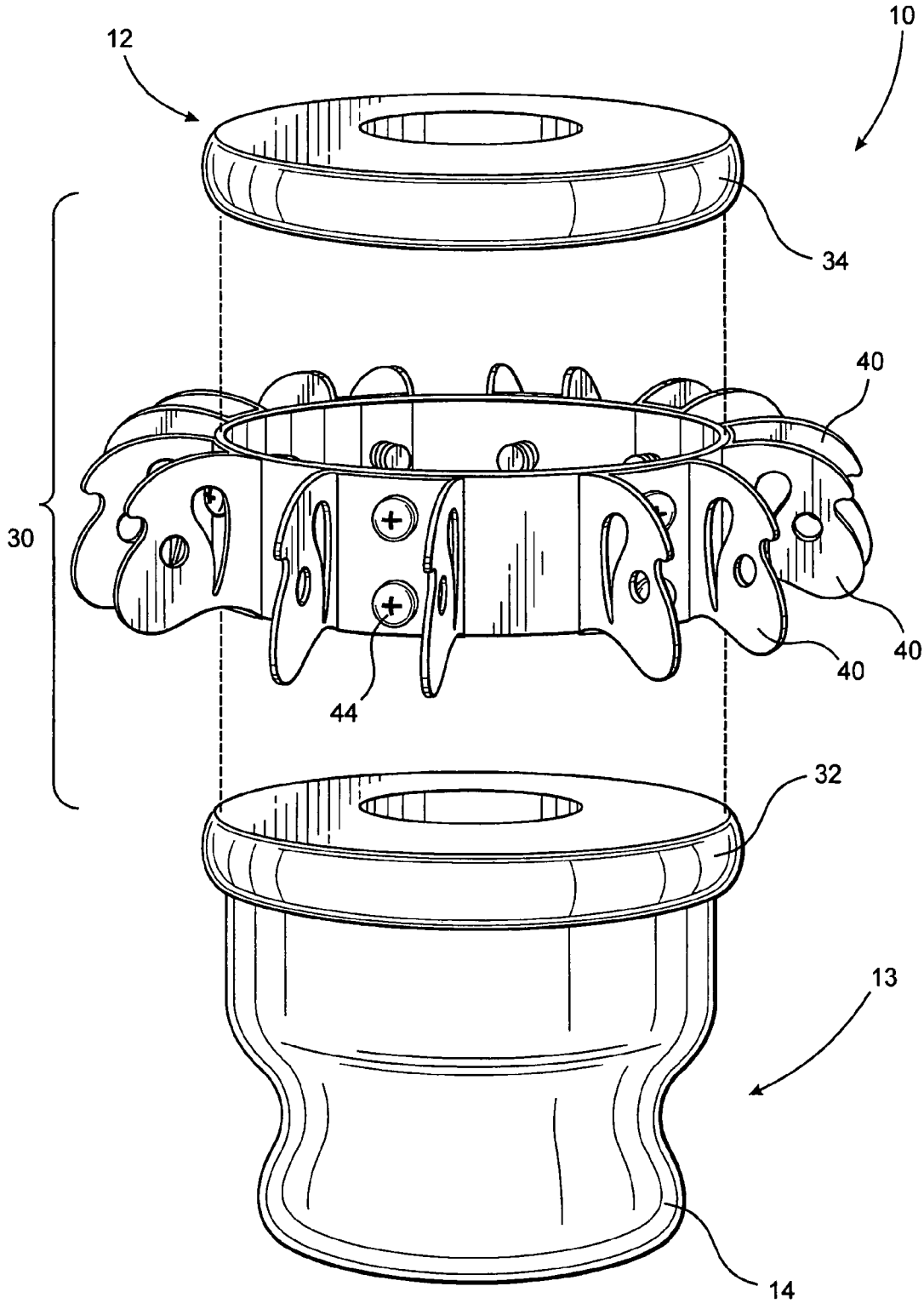

With reference now to FIG. 3-A, the hub member 10 illustrated in these embodiments includes a channel 30 formed around its girth or external peripheral surface. Ideally, the channel 30 is formed at or near the upper portion 12 thereof and further, is defined by both a bottom ledge 32 and a top ledge 34 as shown in FIGS. 2 and 3-A. Alternatively, and although not illustrated in the drawings, the channel 30 may be defined by only one ledge, such as bottom ledge 32. The channel 30 is preferably sized and dimensioned to correspond to the size and dimension of the bracket members 40, such that the rear wall 42 of each bracket member 40 fits within the channel 30 and rests on the ledge 32 or ledges 32, 34. In these embodiments, the bracket members 40 may also be secured within the channel 30 by way of one or more screws 44 driven directly into the wood or other material of the hub member 10. Alternatively, and with reference to FIG. 4, a metal band 20 can be wrapped around the hub member 10 at or preferably within the channel 30, and the bracket members 40 can then be secured thereto by one or more screws. It is contemplated that the channel 30 adds to the stability of the bracket members 40 due to their being kept in vertical alignment by the channel 30, and ideally, both top and bottom ledges 32, 34 thereof. In other words, this channel structure 30 helps to prevent the rotation or twisting and displacement of the bracket members 40, and consequently, they are less likely to become loosened and thereby yield an umbrella frame assembly which is more durable and stable. Further, the bracket members may be readily secured and removed from the channel structure, via screw 44, as shown in FIG. 2. While a screw member is shown as the means of attachment for the brackets to the hub member 10, other forms of attachment may be employed, such as a machine threaded bolt, fitted notch or other element. Also shown in FIG. 3-A is a "cam cleat member" 90 described briefly previously herein, which along with other components, not shown, permits the raising and lowering of the hub member 10 along the central pole member 120 to open and close the umbrella.

In yet another preferred embodiment, and with reference now to FIG. 3-B, the hub member 10 can be formed to have an upper portion 12 that is separate and distinct from the lower portion 14, and as such, this embodiment may be termed a 'split' or separated hub member. In particular, the lower portion 14 of the hub assembly 10 can be formed to include both the waist 13 and the channel 30, preferably with only bottom ledge 32 as discussed previously herein, and in this embodiment, the upper portion 12 is formed to define a ring or disk like top having a slightly larger dimension so as to define upper ledge 34, as illustrated in FIG. 3-B. In this embodiment, the lower portion 14 of the hub assembly 10 is mounted onto the pole of the umbrella first, and then, the upper portion 12 can be mounted on the pole as well, such that a channel 30 having both a bottom ledge 32 and a top ledge 34 is created and sandwiched between the upper and lower portions 12, 14. In other words, in this embodiment the upper and lower portions 12 and 14 are collectively sized and formed to create the channel 30 therebetween in the assembled condition, with preferably, the channel 30 being sized and dimensioned to correspond to the size and dimension of the bracket members 40, such that each bracket member 40 fits within the channel 30 and may be secured within the channel 30 by way of one or more screws driven directly into the hub assembly 10. If desired, a band 20 can be included within the channel of this embodiment.

Figure 5A:
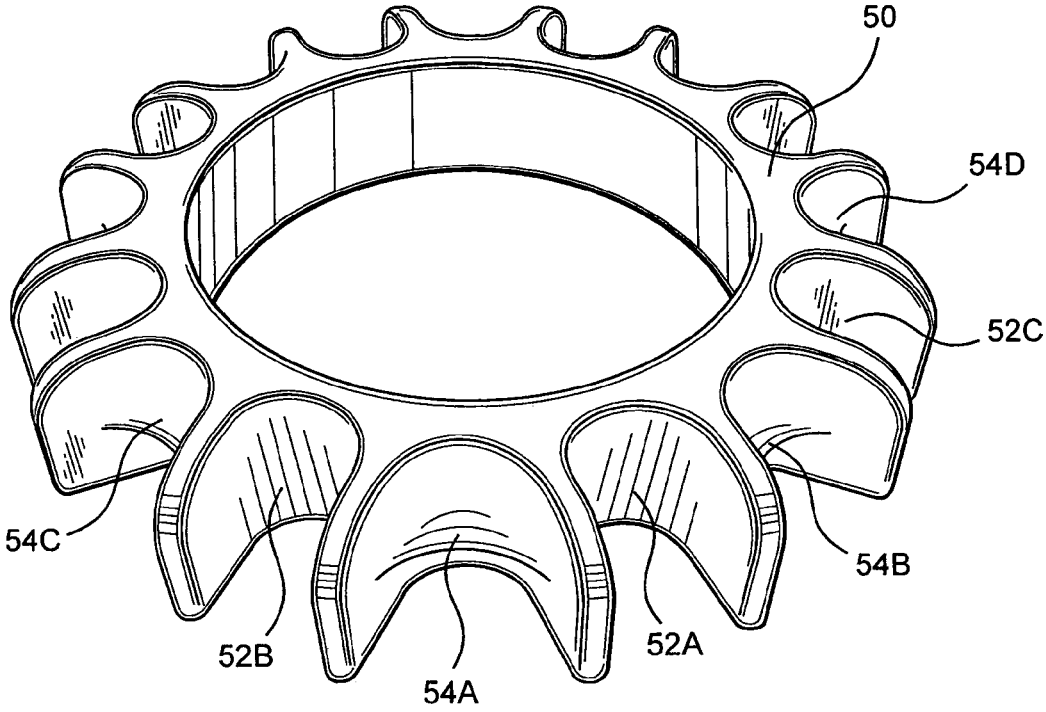
FIG. 5-A is an isolated perspective view of a ring to be incorporated in one embodiment of a hub assembly according to the present invention.
Figure 5B:
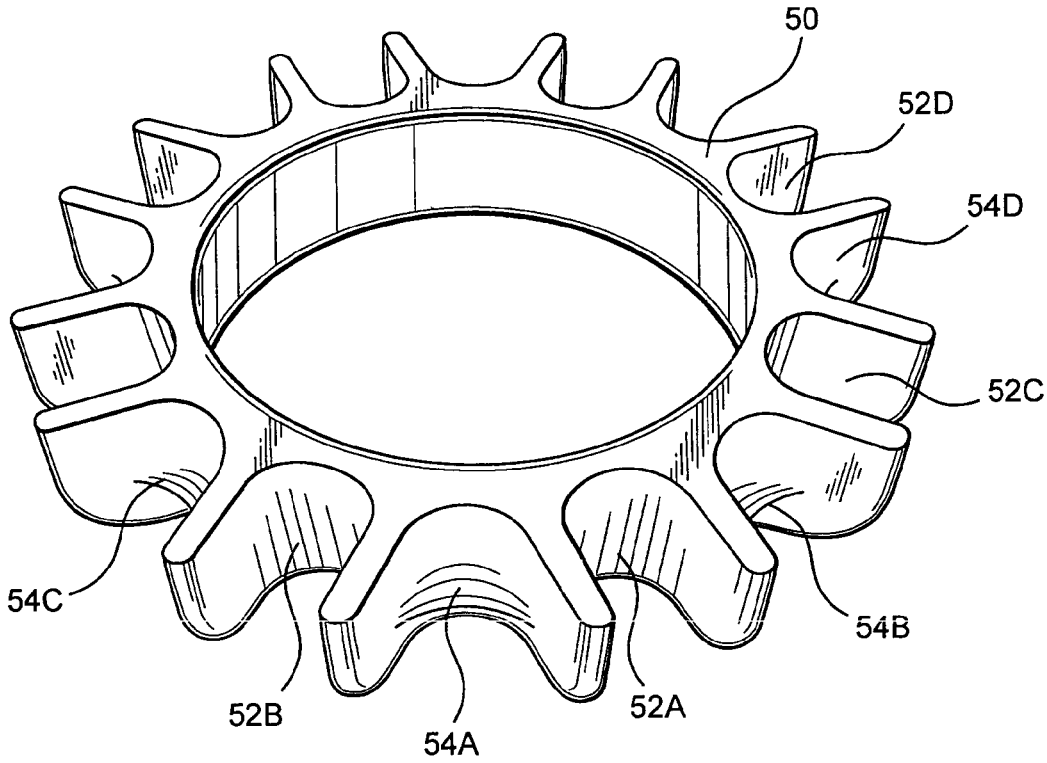

The present invention contemplates yet another embodiment of a 'split' hub assembly, which will now be described with reference to FIGS. 5-A and 5-B. In particular, a ring 50 may be sandwiched between the separate and distinct upper and lower portions of the hub assembly on the pole 120, although in this embodiment, the ring 50 is preferably not secured to either, but instead, is free to rotate about the pole 120 and between the upper and lower portions. Ideally, the ring 50 is made from a plastic material so as to be durable and weather resistant, and further, has a single, one-piece configuration which includes a plurality of pre-formed brackets therein. For example, the pre-formed brackets may comprise a plurality of "U" shaped openings 52*a*, 52*b*, 52*c*, 52*d*, this shape being preferred for providing clearance to the ends 82 of strut members. In the illustrated embodiment of the invention shown in FIGS. 5-A and 5-B, the ring 50 is provided with eight "U" shaped openings so as to accommodate up to eight struts 80, to allow correspondence with a design for an umbrella canopy having eight rib members 70 and strut members 80 or less, such as six or four, as well. The ring 50 may also include other pre-formed brackets, such as a plurality of generally "V" shaped openings 54*a*, 54*b*, 54*c*, 54*d* formed therein, with each having a ledge formed at generally a mid-point of each opening, with there being ideally eight (8) in number as well. In the illustrated embodiment, one of the exterior surfaces, such as the bottom surface as shown in FIG. 5-B may be substantially flat so as to form an approximately or generally about ninety degree angle with the outer edges which define the pre-formed brackets, whereas the opposite exterior surface, such as the top surface shown in FIG. 5-A may have a curved and/or sloped angle at these junctures.

As shown in FIGS. 1, 2 and 4, the secondary hub member 18 is also provided with brackets for pivotally receiving the upper ends of rib members 70. The rib members 70 form the outer framework of the umbrella frame of the present invention whereas the strut members 80 provide support for the rib members when the umbrella frame is in the extended or open position. As shown in FIG. 2, pivotal attachment of the rib and strut members to their respective brackets and hub members may occur by using a single screw extending through the bracket, such as at hole 45, through the strut member (or rib member) and through hole 46, where it can be bolted in place. Other like connectors can be used to allow the strut or rib members to be easily secured and removed from the brackets and indeed, for the brackets themselves to be easily replaceable. The rib and strut members may be made of aluminum or wood, for example. Also, and as shown in FIG. 1, the strut members 80 may be pivotally secured to the rib members 70 by a collar member 96, which has been described in a prior U.S. patent application, identified previously herein and/or in a related "parent" patent application. Also, with the present invention, many different configurations of the canopy can be achieved. For example, four rib members can be employed to form a square shaped canopy, eight rib members can be employed for an octagonal shaped canopy, three rib members can be employed for a triangular shaped canopy, six rib members can be employed for a rectangular shaped canopy and five rib members can be employed for a semi-octagonal shaped canopy. The number of ribs to be employed determines the number of strut members, and brackets to be employed. For example, with four rib members, four strut members and four brackets are employed. Canopies of varying shapes and sizes are attached to the umbrella frame by unscrewing the finial or end cap 17 from the top end 14 of the pole 120 and removing a securing nut. The canopy opening is placed over the threaded bolt 65 and the canopy cuffs are placed around the outer ends of the rib members. The securing nut and finial 17 are then placed back onto the threaded bolt 65. In one embodiment of the invention, the canopy members are SUNBRELLA 100% solution-dyed acrylic canopies or any other shade-like or non-shade like material.

When the frame is in the retracted position, as shown in phantom in FIG. 1, the inventive hub member 10 is near the bottom end 160 of the pole 120. As the hub member 10 is lifted up the pole 120, the strut members 80 extend outwardly, thereby expanding the rib members 70 and opening the attached canopy. As the strut members 80 pass the point where they extend perpendicularly from the pole member 120, the strut members 80 lock into place against a hub stop member (not shown) secured to the pole, and the retaining pin member 112 may then be placed within its retaining slot on the pole 120 and the hub member 10 may then be returned downwardly to rest against the pin member 112. In this position, the strut members 80 extend in a substantially perpendicular fashion from the pole member 120 to provide substantial support to the rib members 70. With the present invention, the umbrella's frame 100 may be rotated by a loosening of the end cap 17 and securing nut from the pole's top end 140, in an amount sufficient to allow for either slight or ready rotation of the hub member 10, 18 about the pole 120. The umbrella frame may also employ a cable and pulley system, preferably with a cam mechanism 90 shown in FIG. 3-A, to allow the user to easily raise the hub member 10 and thereby open the umbrella and/or lower it to close the umbrella.

The rigidity and density of all the components described herein can be tempered for a desired flexibility as needed. The pole, rib, and strut members may be comprised of metal, wood or fiberglass but not limited to these rigid compositions. The nature of thermoplastic construction with materials like ABS, DELRIN, POLYPROPOLYNE and other ACETALS allow for a degree of flexibility in the members of the umbrella frame. In heavy wind conditions the static frame work moves a few degrees in many directions and the tension of this movement is absorbed but not released. This type of stress over time degrades the structural integrity of an umbrella. Because these plastics have a degree of flexibility, the energy that normally would be absorbed by a completely static frame umbrella is distributed through all of the plastic components of the umbrella. This greatly increases the life of the static frame of an outdoor umbrella which is generally the more costly portion of an umbrella unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A hub assembly in combination with an umbrella frame having a pole member comprising:

a hub member having a central aperture, said hub member movably mounted on the pole member of the umbrella frame and slidable along a length of the pole member between a bottom end and a top end thereof, said hub member having an upper portion and a lower portion, a band secured to an exterior peripheral surface of said hub member substantially adjacent said upper portion, and a plurality of brackets disposed in overlying relation to said band and fixedly connected to said hub member, each of said plurality of brackets pivotally connected to an end of a corresponding strut member of the umbrella frame.

2. A hub assembly as recited in claim 1 wherein said hub member includes a waist portion, said waist portion being of smaller diameter than said upper and lower portions.

3. A hub assembly as recited in claim 1 wherein said band comprises a substantially flat configuration.

4. A hub assembly as recited in claim 3 wherein said band further comprises a metallic material.

5. A hub assembly as recited in claim 3 wherein said band further comprises plastic.

6. A hub assembly as recited in claim 1 wherein said band is fixedly secured to said exterior peripheral surface of said hub member.

7. A hub assembly as recited in claim 1 wherein said band comprises a metallic material.

8. A hub assembly as recited in claim 1 wherein said band comprises plastic.

9. An umbrella frame comprising:

a pole member having a longitudinal axis, a bottom end and a top end, said pole member also having a retaining pin slot extending therethrough;

a main hub member secured about said central pole member, said main hub member capable of sliding between said bottom and said top ends, said main hub member also capable of rotating about the axis of said pole member, said main hub member having an upper portion and a lower portion and a band secured about a periphery thereof between said upper and lower portions, a plurality of brackets secured to said band and hub member, a secondary hub member secured to said pole member near said pole top end, said secondary hub member also capable of rotating about said central pole axis, a plurality of rib members pivotally secured to said secondary hub member, a plurality of strut members each having an inner and an outer end, said inner ends being pivotally secured to said brackets on said main hub member respectively, said outer end of each of said strut members being pivotally secured to a respective one of said rib members, a pin member extendable within said retaining pin slot for maintaining said main hub member in position along said pole member, and means for securing said pin member to said main hub member so as to allow said umbrella frame to rotate freely about said pole member when said pin member is placed within said retaining pin slot.

10. A hub assembly for an umbrella frame comprising:

a hub member having a central aperture sized to receive a pole member of the umbrella frame, said hub member being capable of sliding between a bottom end and a top end of the pole member, said hub member having an upper portion and a lower portion, a band secured to said hub member about a periphery thereof between said upper and lower portions, a channel formed generally in said upper portion, said channel being defined by at least a lower ledge extending about a periphery of said hub member, and wherein said band is secured to said hub member about said channel, and a plurality of brackets disposed within said channel in overlying relation to said band and fixedly secured to said hub member, wherein said brackets are structured to pivotally receive an end of a strut member of the umbrella frame.

11. A hub assembly as recited in claim 10, wherein said channel has a height dimension that is sized to correspond generally with a height dimension of said brackets.

12. A hub assembly in combination with an umbrella frame having a pole member comprising:

a hub member having a central aperture sized to receive the pole member of the umbrella frame, said hub member movably mounted on the pole member and slidable along a length thereof between a bottom end and a top end thereof, said hub member having an upper portion and a lower portion, a channel continuously disposed on said hub member and extending about an exterior peripheral surface thereof, said channel being defined by an upper ledge and a lower ledge projected outwardly from said exterior periphery surface of said hub member, a plurality of brackets disposed within said channel and fixedly connected to said hub member so as to prevent rotational movement of said brackets, and said plurality of brackets pivotally connected to end said channel being defined by an upper ledge and a lower ledge projected outwardly from said exterior periphery surface of said hub member, portions of a plurality of strut members of the umbrella frame.

13. A hub assembly as recited in claim 12 wherein said plurality of brackets are fixedly disposed within said channel in spaced relation to one another.

14. A hub assembly as recited in claim 12 further comprising a band disposed within and extending along a length of said channel.

15. A hub assembly as recited in claim 14 wherein said plurality of brackets are connected to said band and collectively extend about an exterior periphery of said hub member.

16. A hub assembly as recited in claim 12 wherein said channel is formed in and at least partially defines said exterior peripheral surface of said hub member.

17. A hub assembly as recited in claim 16 wherein said channel is formed adjacent said upper portion of said hub member.

18. A hub assembly as recited in claim 17 wherein said lower ledge extends continuously along a length of said channel.

19. A hub assembly as recited in claim 18 wherein said upper ledge disposed in spaced relation to said lower ledge and extending continuously along a length of said channel.

20. A hub assembly as recited in claim 19 wherein said plurality of brackets are dimensioned and configured to be fixedly secured to said hub member within said channel and between said lower and upper ledges.

* * * * *

UNITED STATES PATENT AND TRADEMARK OFFICE

CERTIFICATE OF CORRECTION

PATENT NO. : 7,318,444 B2
APPLICATION NO. : 10/748755
DATED : January 15, 2008
INVENTOR(S) : Dougan H. Clarke It is certified that error appears in the above-identified patent and that said Letters Patent is hereby corrected as shown below:

In column 10, lines 10-12, the phrase "said channel being defined by an upper ledge and a lower ledge projected outwardly from said exterior periphery surface of said hub member" should be deleted, such that column 10, lines 9-13 read as follows:

> said plurality of brackets pivotally connected to end
> portions of a plurality of strut members of the umbrella frame.

Signed and Sealed this

Fifth Day of May, 2009

John Doll

JOHN DOLL
*Acting Director of the United States Patent and Trademark Office*